US005225254A

United States Patent [19]

Foulke

[11] Patent Number: 5,225,254

[45] Date of Patent: Jul. 6, 1993

[54] PLASTIC FOAM SAFETY CONE AND METHOD

[75] Inventor: Robert W. Foulke, San Clemente, Calif.

[73] Assignee: PI Consumer Products Corporation, Hyannis, Mass.

[21] Appl. No.: 823,154

[22] Filed: Jan. 21, 1992

[51] Int. Cl.[5] ..... B65D 5/00

[52] U.S. Cl. ..... 428/12; 116/63 C; 229/116; 229/185; 428/542.8

[58] Field of Search ..... 428/542.8, 12; 116/63 C; 229/116, 185

[56] References Cited

U.S. PATENT DOCUMENTS

| | | | |
|---|---|---|---|
| 4,133,137 | 1/1979 | van Adelsberg | 229/116 X |
| 4,265,963 | 5/1981 | Matalon | 428/290 X |
| 4,798,747 | 1/1989 | Laramee | 428/542.8 X |
| 4,986,464 | 1/1991 | Leigh | 229/116 |
| 5,014,455 | 5/1991 | Desaderata | 428/542.2 X |
| 5,090,349 | 2/1992 | Wilson | 116/63 C |

*Primary Examiner*—Henry F. Epstein
*Attorney, Agent, or Firm*—Richard P. Crowley

[57] ABSTRACT

A foam sheet material prepared by a single die-cut operation, to provide a foam sheet material with three foam panels connected by a living hinge, and with closure means on the outer edges of two of the panels. The die-cut sheet material is adapted to move between a flat, stacked, storing or packaging position and a vertically upright, cone-like-structure position.

16 Claims, 1 Drawing Sheet

PLASTIC FOAM SAFETY CONE AND METHOD

BACKGROUND OF THE INVENTION

There are a variety of plastic-type, vertically standing upright, conical or pyramidical-type structures, which are often referred to as cone structures, employed as safety cones to designate particular areas, such as, for example, field markers or traffic and safety-lane markers, and for other marking and designation purposes. Typically such conical-like structures are unitarily formed of a flexible or rigid plastic material, either of solid or foam material, the conical or cone-like or pyramidical-type shapes tapering from the base to the top. The cone-like structures may have a light or fluorescent color, to attract visual attention, and also may have a printed or designed indicia thereon for informational purposes. Generally such cone-like structures are stored by placing one cone-like structure on another in a stacked, nesting-type relationship, prior to transportation and use in a designated position.

It is desirable to provide for a new and improved plastic cone-like structure and a method of preparing and employing such structure, using inexpensive materials and an inexpensive method of manufacturing. It is also desirable to provide plastic cone-like structures which can be packaged and stored readily and be formed easily into an upright, cone-like structure when in use.

SUMMARY OF THE INVENTION

The present invention relates to a plastic-foam, cone-like structure and to a method of preparing, assembling and using such structure. In particular, the invention concerns plastic-foam safety cones inexpensively manufactured and formed, and which can be moved readily between a foldable, stacked position and a vertical, upright cone-use position.

A new, improved and unique safety cone-like structure has been discovered which is easily manufactured by a single die cut of a flexible foam material, which foam material may have a thin film on one or both sides thereof, which foam material has living hinges at the folding lines, and a fastener means at the outer edges, such as snap-mechanism means, integrally formed to permit the joining of the outer edges or seams to form the cone-like structure. The flexible foam sheet material may comprise an extruded-type foam sheet material which, by a single die cut, provides living hinges, for folding purposes, at the cut line, and an outer snap-type fastener mechanism, to join the outer seams together. The flexible foam material, typically in sheet form, is adapted to move between a compact, stored, packaging position, wherein the foam sheet material is stacked in a vertical arrangement, to a vertically standing, upright, cone-like structure, with the flexible-foam sheet material secured at the outer edges, to form a stable, cone-like structure.

The invention relates to a sheet material adapted to form an upright cone-like structure, which sheet material comprises a generally flat, typically a trapezoidal-shaped, sheet material composed of a flexible or semirigid plastic foam material, generally of sufficient thickness; for example, ⅛th to ½ inch, and more typically ¼th inch, to support a vertically upright, bending, cone-like structure. The flat sheet material has a plurality of straight-line cuts therein typically formed by a single die cut, to form the first, second and third adjacent generally triangular or trapezoidal foam sheet sections in the flat foam sheet material. The straight-line cuts to form the section typically do not cut entirely through the flat foam sheet material, but only 25% to 75% of the sheet material, and, in one preferred embodiment, one cut is deeper than the other; for example, one cut being 25% and the other cut being 75%, to permit the easy folding over of the flat-sheet sections in a compact, storing, packaging and shipping arrangement. The sections of the flat sheet material have the uncut line sections forming living-hinge means, to permit the triangular or trapezoidal foam-sheet section so formed to move between a flat, folded position, with said sections adjacent and overlapping each other for compact shipping and storing, and a three-sided, upright cone-like structure position formed by the three flat foam sections, by securing the outer edges of two of the first and third foam sections together, to form a stable-base, cone-like structure. Typically, there is integrally formed with the flat foam-type structure an integrally formed fastener means on each of the outer edges of the first and third outer foam sections, which permits and provides for the easy fastening together of the outer edges of the first and third foam sections, to form the cone-like structure. Generally, the integrally formed fastener means may comprise a plurality, such as two or three, outwardly extending tabs or male-like elements from one outer edge and corresponding female cavities or indents in the opposite outer edge of the opposite foam-like section, so that the male and female integrally formed members may be snapped together in a fastening arrangement, to hold the three cut-foam sections in a cone-like structure.

The sheet material employed in the manufacture of the cone-like structure comprises a generally flat sheet material of a flexible or semirigid foam material, typically an inexpensive foam material, such as an olefinic foam material, and more particularly a polyethylene or polypropylene foam material; for example, an extruded, expanded polyethylene and optionally a cross-linked foam material having generally a foam density, for example, ranging from 2 to 12 pounds per cubic foot, and more typically about 4 to 8 pounds per cubic foot, and having a thickness ranging from ⅛th of an inch to ½ an inch, and more typically about ¼th of an inch. Optionally, if desired, the foam sheet may include a thin, solid, extruded plastic film extruded onto one or both surfaces of the expanded foam sheet material, such as, for example, a film of 10 to 50 mils in thickness; for example, 15 to 30 mils in thickness, of polyethylene, to impart enhanced strength to the foam sheet structure, or, if the foam section is to be cut completely in half, to act as a living hinge alone or with the uncut section of the foam sheet material.

The cone structure is formed by a single die-cutting through the foam sheet material in a straight line, to form three first, second and third triangular, foam sections, where the top is to be closed, or more typically trapezoidal-type foam sections, with the uncut portion of the flat sheet material acting as a foam or film living hinge, to permit the three sections to be folded and to form the cone structure, and also to be folded and formed in a compact storage position for storing and shipping. Where a trapezoidal foam section is employed, a three-sided, erected, vertically upright, conical-type structure will have an open, triangular-shaped top. Generally the trapezoidal section will have a base which ranges from four to eight times the length of the top parallel line of the trapezoid. Where the sections are triangular in nature, then the top of the cone-like structure will be pointed, which sometimes is not wholly desirable and may lead to breaking off of the conical shape. It has been found that, although four sections may be cut of the foam material, such four-sided, conical-like structures can collapse more readily and are not as stable as the three-sided structures, since there is a hinge or section opposing the opposite living-hinge section in the four-sided structure, leaving some degree of instability.

As in other cone-type or safety-marker-type structures, the cone-like structures of the invention may be composed of bright or fluorescent-type or other colors, such as bright red or orange, or the foam sections may be the same or different colors, and may also contain on one, two or three sides a design or indicia or lines or other material as desired.

The cone-like structure of the invention includes integrally formed, in the die-cutting operation on the opposite edges of a generally trapezoidal-shaped flat sheet material, a plurality of fastening means, and typically a male member, such as an extension, like two, three or four T-shaped extensions, on one edge of one foam section, and corresponding female receptors or indents on the opposite section, to receive the male sections, so that the cone-like structure may be maintained in an upright, vertical, three-sided position, and yet be dismantled easily by hand pressure, to remove the male members from the female cavities, so that the sheet material may move between a compact, packaged and folded position and a vertically upright, three-sided, conical structure position.

The conical-like structure and method of the present invention provide for easy, rapid and inexpensive manufacture through the employment of a single die-cutting operation, which forms the living hinges, the exterior lines of the flat sheet material and the fastening means, and further provides for the easy packing, storing and shipping of the material in a flat, folded form, and for the easy erection of the cone-like structure.

The invention will be described for the purposes of illustration only, in connection with certain embodiments; however, it is recognized that various modifications, changes, additions and improvements may be made in the illustrated embodiments, without departing from the spirit and scope of the invention.

DESCRIPTION OF THE EMBODIMENTS

Figure 1:
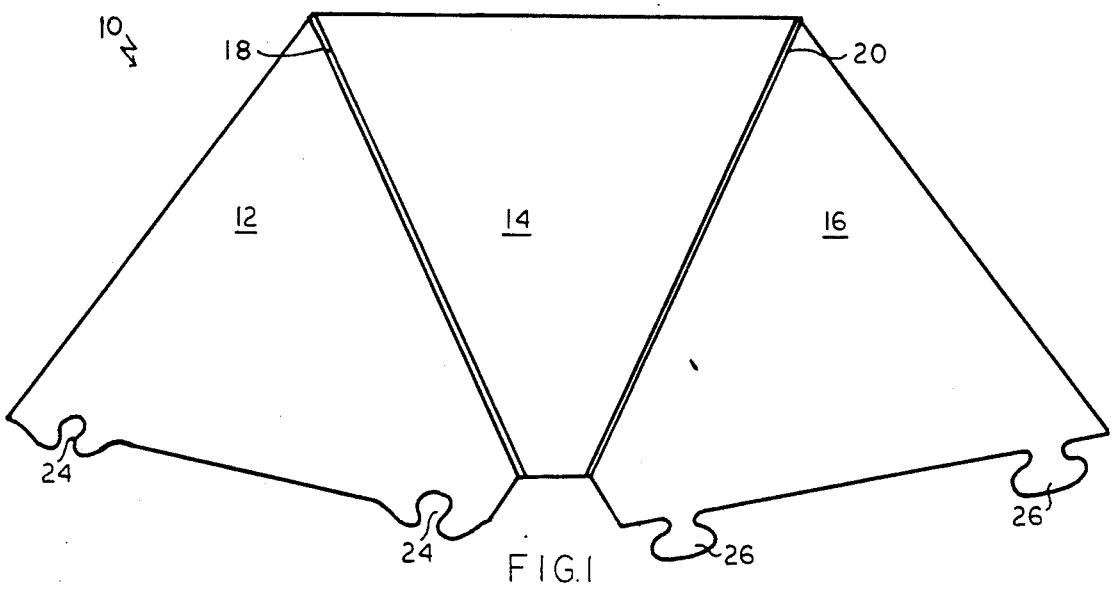
FIG. 1 is a top plan view of a die-cut, flexible foam sheet material of the invention.

FIG. 1 shows a flexible foam sheet material 10 of an extruded, expanded, polyethylene foam material having a density of about 4 to 6 pounds per cubic foot, and composed of three separate trapezoidal sections 12, 14 and 16, the sections having a partial die cut through the flat sheet material 10, to form die-cut hinges 18 and 20 in the noncut sections of the foam sheet material 10. The foam sheet material includes an exterior thin-film, extruded, laminated, polyethylene sheet 22 laminated to the outside surface of the foam sheet material 10, having a thickness of about 20 to 30 mils. The sheet material 10 includes a pair of female cavities or indentations 24 on the outer edge of the foam section 12, and includes corresponding mating, externally extending, T-shaped male members 26 engaged matingly to be snapped into the female indentations 24. Thus the flexible foam sheet material 10 is easily prepared by just merely die-cutting the entire sheet from a sheet of flexible foam material, to form the die-cut living hinges 18 and 20 and the female- and male-fastening members 24 and 26 in the separate, foldable foam sections 12, 14 and 16. The sheet material 10 has been die cut, to form the living hinges 18 and 20, at different depths, so that the sections 12 and 16 may be folded over one another.

Figure 2:
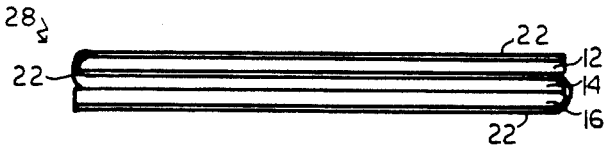
FIG. 2 is a perspective view from above of the flexible foam-like sheet material of FIG. 1 in a folded storing or packaging position.

FIG. 2 shows the sheet material 10 as die cut in a compact, packaging, storing and folding position 28.

Figure 3:
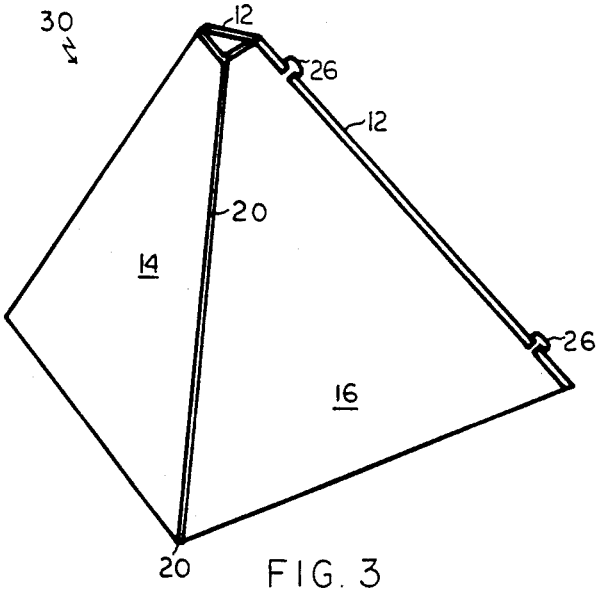
FIG. 3 is a perspective view from above of the cone-like structure of the invention in an integrally erect, cone-like position.

FIG. 3 shows the sheet material 10 as a cone-like, upright, three-paneled structure 30 comprising the upright, slanted foam panels 12, 14 and 16, and with the male members 26 hand-inserted by pressure in indents 24, to form a stable, vertically upright cone structure 30 for use as a safety cone. As illustrated, the cone-type structure 30 has a generally triangular opening at the top thereof, due to the trapezoidal nature of the foam panels 12, 14 and 16. Such cone-like structures have a variety of uses and may be employed as marking devices, as well as protective devices, particularly when employed in triangular, foam-section form, to cover up plants, such as, for example, rose plants, to prevent a freeze/thaw cycle, or for other uses attributable to cone-like structures.

What is claimed is:

1. A sheet material adapted to form an upright, three-sided, cone structure, which sheet material comprises:

a) a generally flat, shaped sheet material composed of a semirigid or flexible plastic-foam material;

b) the sheet material having straight-line cuts therein, to form first, second and third, adjacent, triangular or trapezoidal foam-sheet sections, the straight-line cuts only partially extending through the depth of the foam;

c) hinge means formed by the uncut line sections of the sheet material, to permit the flat-foam sheet sections to move between a flat, folded, compact, storing or shipping position, with said foam sections stacked adjacent and overlapping each other, and a three-sided, upright, cone structure position formed by the three, inclined, flat-foam sections; and d) integrally formed fastening means on the outer edges of the first and third flat-sheet foam sections, to provide for the snap-fastening together of the outer edges of the first and third foam sections, to form the cone structure.

2. The sheet material of claim 1 wherein the flat-foam sheet material comprises an extruded, polyethylene foam sheet material.

3. The sheet material of claim 1 wherein the partial straight-line cuts extend from about 25% to 75% of the depth of the flat-foam sheet material.

4. The sheet material of claim 1 wherein the straight-line partial cuts, to form the flat-foam sheet sections, extend for different thicknesses on each side of the foam-sheet sections.

5. The sheet material of claim 1 wherein the flat sheet material includes an extruded plastic film secured onto at least one surface of the flat-foam sheet material.

6. The sheet material of claim 5 wherein the extruded plastic film comprises an extruded polyethylene film of about 10 to 30 mils in thickness.

7. The sheet material of claim 1 wherein the foam density of the sheet material ranges from about 2 to 12 pounds per cubic foot.

8. The sheet material of claim 1 wherein the fastening means includes, extending from one edge of the first or third foam section, a plurality of male elements formed of the foam sheet material, and a plurality of female indents, on the other first or third opposing edge, adapted to receive and retain the male elements, when the sheet material is placed in a generally vertically upright, three-sided, cone structure.

9. The three-sided, generally vertically upright, three-paneled, cone structure formed by the sheet material of claim 1.

10. The sheet material of claim 1 wherein the first and third foam sections are arranged and folded in an adjacent, stacked, compact, storing or packaging position.

11. A method of preparing a sheet material adapted to form a generally vertically upright, three-sided, cone structure, which method comprises:

a) providing a shaped foam sheet material composed of a flexible or semirigid foam sheet;

b) cutting to a defined depth the foam sheet material, to form three, separate, triangular- or trapezoidal-shaped foam sections, the cuts adapted to provide hinges for the inward movement of the foam sections between a folded, stacked, adjacent, packaging or storing position and a generally vertically upright, three-sided, cone structure position; and c) forming, on the outer edges of the foam sheet material by cutting, integrally formed, snap-in fastening means, which fastening means are snapped together, to hold the material in the upright, cone structure.

12. The method of claim 11 which includes die-cutting a polyethylene, extruded, foam sheet material, to form partially straight-line die cuts in the foam sections, and to form the fastening means on the outer edges of the outer foam sections.

13. The method of claim 11 which includes extruding and laminating, onto one surface of the foam sheet material, a thin, polyethylene film material.

14. The method of claim 11 wherein the foam sheet material comprises an extruded, polyethylene, foam sheet material having a density of about 2 to 12 pounds per cubic foot, and wherein the fastening means includes male elements on one outer edge and female indent means on another outer edge, the male and female means adapted to be placed in a snapped-in, fastening arrangement.

15. The method of claim 11 which includes cutting to a defined depth of about 25% to 75% of the depth of the flat foam sheet material to form the foam sections.

16. The method of claim 11 which includes cutting the foam sheet material to different depths ranging from about 25% to 75% of the depth of the foam sheet material to permit the foam sheet material to be flat folded in a compact storing or shipping position.

* * * * *